United States Patent [19]

Yamaguchi et al.

[11] Patent Number: 5,028,581

[45] Date of Patent: Jul. 2, 1991

[54] ODORLESS MULTI-VALENT METAL MODIFIED PRODUCTS OF SALICYCLIC ACID COPOLYMERS, PRODUCTION PROCESSES THEREOF, AND USE THEREOF AS COLOR-DEVELOPING AGENTS FOR PRESSURE-SENSITIVE COPYING PAPER SHEETS

[75] Inventors: Keizaburo Yamaguchi, Chiba; Yoshimitsu Tanabe, Yokohama; Akihiro Yamaguchi, Kamakura, all of Japan

[73] Assignee: Mitsui Toatsu Chemicals, Incorporated, Tokyo, Japan

[21] Appl. No.: 393,247

[22] Filed: Aug. 14, 1989

[30] Foreign Application Priority Data

Aug. 15, 1988 [JP] Japan ..... 63-201878

[51] Int. Cl.[5] ..... B41M 5/30; B41M 5/32

[52] U.S. Cl. ..... 503/211; 427/150; 503/212; 503/216; 503/225

[58] Field of Search ..... 427/150; 503/210-212, 503/216, 225

[56] References Cited

U.S. PATENT DOCUMENTS

| | | | |
|---|---|---|---|
| Re. 29,316 | 7/1977 | Bargain et al. | 260/30.2 |
| 3,129,105 | 4/1964 | Berry et al. | 106/55 |
| 3,658,764 | 4/1972 | Bargain et al. | 260/78 UA |
| 3,830,777 | 8/1974 | Burton | 260/37 N |
| 3,862,918 | 1/1975 | Laurent et al. | 260/37 N |
| 4,046,941 | 9/1977 | Saito et al. | 428/323 |
| 4,065,345 | 12/1977 | Progar et al. | 156/309 |
| 4,075,171 | 2/1978 | D'Alelio | 260/47 CP |
| 4,076,697 | 2/1978 | Forgo et al. | 260/78 UA |
| 4,116,937 | 9/1978 | Jones et al. | 528/170 |
| 4,134,847 | 1/1979 | Oda et al. | 252/62.1 P |
| 4,144,284 | 3/1979 | Semanaz et al. | 260/857 PA |
| 4,173,684 | 11/1979 | Stolfo | 428/531 |
| 4,269,893 | 5/1981 | Kato et al. | 428/341 |
| 4,4350,560 | 3/1984 | Takahashi et al. | 528/170 |
| 4,390,596 | 6/1983 | Laurent | 428/473.5 |
| 4,393,177 | 7/1983 | Ishii et al. | 525/422 |
| 4,433,104 | 2/1984 | Giles, Jr. | 525/180 |
| 4,526,838 | 7/1985 | Fujioka et al. | 428/458 |
| 4,535,101 | 8/1985 | Lee et al. | 521/189 |
| 4,598,115 | 7/1986 | Fujioka et al. | 524/376 |
| 4,599,396 | 7/1986 | Takekoshi et al. | 528/185 |
| 4,691,025 | 9/1987 | Domeier et al. | 548/521 |
| 4,707,316 | 11/1987 | Fujioka et al. | 264/135 |
| 4,737,568 | 4/1988 | Stenzenberger | 528/170 |
| 4,772,237 | 10/1988 | Dien et al. | 528/322 |
| 4,831,102 | 5/1989 | Yamaya et al. | 528/170 |

FOREIGN PATENT DOCUMENTS

| | | | |
|---|---|---|---|
| 0186516 | 7/1986 | European Pat. Off. | 503/215 |
| 0192480 | 8/1986 | European Pat. Off. | 525/185 |
| 0253586 | 1/1988 | European Pat. Off. | 525/185 |
| 0264751 | 4/1988 | European Pat. Off. | 503/200 |
| 0283924 | 9/1988 | European Pat. Off. | 503/200 |
| 40-9309 | 2/1965 | Japan | 503/200 |
| 42-20144 | 7/1967 | Japan | 503/200 |
| 17856 | 5/1972 | Japan | 503/200 |
| 49-10856 | 3/1974 | Japan | 503/200 |
| 52-1327 | 1/1977 | Japan | 503/200 |
| 55-19792 | 11/1980 | Japan | 503/200 |

(List continued on next page.)

OTHER PUBLICATIONS

Experimental Chemistry, (Jikken Kagaku Koza), The Maruzen Publishing Co., Ltd., vol. 18, No. 30 (1958), pp. 28 to 31 and 82 to 85.

Kogyo Kagaku Zaashi, 65(4), pp. 626-629 (1962).

*Primary Examiner*—Bruce H. Hess

*Attorney, Agent, or Firm*—Fisher, Christen & Sabol

[57] ABSTRACT

Odorless or absolutely ordorless multi-valent metal-modified salicylic acid. The former copolymers are obtained by condensing salicylic acid with a benzyl aldehyde, reacting the resultant resin with a styrene derivative and reacting the resin thus-obtained with a multivalent metal salt. The latter copolymers are obtained by adding water dropwise to the resultant multi-valvent metal-modified resin at a temperature above the boiling point of water to remove completely volatile matters.

6 Claims, 1 Drawing Sheet

FOREIGN PATENT DOCUMENTS

| | | | |
|---|---|---|---|
| 50691 | 3/1984 | Japan | 503/200 |
| 168030 | 9/1984 | Japan | 503/200 |
| 59560 | 4/1985 | Japan | 503/200 |
| 80162 | 5/1985 | Japan | 525/185 |
| 96652 | 5/1985 | Japan | 525/185 |
| 101932 | 6/1985 | Japan | 525/185 |
| 108513 | 6/1985 | Japan | 525/185 |
| 61-100493 | 1/1986 | Japan | 503/200 |
| 194055 | 8/1986 | Japan | 525/185 |
| 221158 | 10/1986 | Japan | 503/200 |
| 61-262019 | 11/1986 | Japan | 503/200 |
| 62-6218 | 1/1987 | Japan | 503/200 |
| 62-18472 | 1/1987 | Japan | 503/200 |
| 62-19672 | 1/1987 | Japan | 503/200 |
| 62-84045 | 4/1987 | Japan | 503/200 |
| 47-96449 | 5/1987 | Japan | 503/200 |
| 62-96449 | 5/1987 | Japan | 503/200 |
| 112537 | 5/1988 | Japan | 503/200 |
| 132857 | 6/1988 | Japan | 503/200 |
| 77515 | 3/1989 | Japan | 503/200 |
| 56724 | 8/1989 | Japan | 503/200 |
| 1263234 | 2/1972 | United Kingdom | 525/185 |
| 1440550 | 6/1976 | United Kingdom | 525/185 |
| 1571487 | 7/1980 | United Kingdom | 503/200 |

ODORLESS MULTI-VALENT METAL MODIFIED PRODUCTS OF SALICYCLIC ACID COPOLYMERS, PRODUCTION PROCESSES THEREOF, AND USE THEREOF AS COLOR-DEVELOPING AGENTS FOR PRESSURE-SENSITIVE COPYING PAPER SHEETS

BACKGROUND OF THE INVENTION (1) Field of the Invention

The invention relates to multi-valent metal-modified products of salicylic acid copolymers which have little or no smell (odor), production processes thereof, and use thereof as color developing agents for pressure-sensitive copying paper sheets.

(2) Description of Prior Art

Pressure-sensitive copying paper sheets are also called carbonless copying paper sheets. They produce a color by mechanical or impactive pressure, for example, by writing strokes or typewriter impression, thereby allowing one to make a plurality of copies at the same time. Among such pressure-sensitive copying paper sheets, there are those called "transfer type copying paper sheets", those called "self-contained copying paper sheets", etc. Their color-producing mechanisms are each based on a color-producing reaction between an electron-donating colorless dyestuff precursor and an electron-attracting color-developing agent. A pressure-sensitive copying paper sheet of the transfer type, by way of example, is described with reference to FIG. 1.

The back sides of a CB-sheet 1 and CF/CB-sheet 2 are coated with microcapsules 4 which have diameters of several micrometers to somewhat greater than 10 micrometers and have been obtained by dissolving a colorless pressure-sensitive dyestuff precursor in a non-volatile oil and then encapsulating the resultant solution with high-molecular films, such as, gelatin films. On the other hand, the front sides of the CF/CB-sheets 2 and a CF-sheet 3 are coated with a coating formulation containing a color-developing agent 5 which has such properties that, upon contact with the pressure-sensitive dyestuff precursor, the color-developing agent 5 undergoes a reaction with the dyestuff precursor, thereby causing the dyestuff precursor to produce its color. In order to make copies, they are stacked in the order of the CB-sheet, (CF/CB-sheet), (CF/CB-sheet) and CF-sheet with the sides coated with the dyestuff precursor maintained in contiguous relation with the sides coated with the color-developing agent. The CF/CB-sheets are optional. When pressure is applied locally by a ball-point pen 6 or a typewriter, the capsules 4 thereunder are ruptured. As a result, the solution containing the pressure-sensitive dyestuff precursor is transferred to the color-developing agent 5 so that one or more copies records are obtained.

As electron-attracting color-developing agents, there have been proposed: (1) inorganic solid acids such as acid clay and attapulgite, as disclosed in U.S. Pat. No. 4,173,684; (2)substituted phenols and diphenols, as disclosed in Japanese Patent Publication No. 9309/1965; (3) p-substituted phenol-formaldehyde polymers, as disclosed in Japanese Patent Publication No. 2044/1967; (4) metal salts of aromatic carboxylic acids, as disclosed in Japanese Patent Publication Nos. 10856/1974 and 1327/1977; etc. Actually, some of them have already been employed.

The following are performance conditions which a color-developing sheet is supposed to satisfy color: little yellowing during storage and upon exposure to radiant rays such as sunlight; good fastness of produced color marks so that they do not disappear or fade easily by radiant rays, water or a plasticizer; excellent color-developing ability not only right after its fabrication, but also after its storage over a long period of time.

Color-developing agents, which have been proposed to date, and sheets coated with such conventional color-developing agents have both advantages and disadvantages in performance. For example, inorganic solid acids are inexpensive but adsorb gas and moisture in the air during storage. They, hence, result in yellowing of paper surfaces and reduced color-producing performance. Substituted phenols have insufficient color-producing ability and produced color marks have low color densities. Para-phenylphenol-novolak resins which are usually employed as p-substituted phenol-formaldehyde polymers have excellent color-producing ability, but their coated paper sheets undergo yellowing and their produced color marks are faded significantly upon exposure to sunlight or during storage (especially, by nitrogen oxides in the air). In addition, metal salts of aromatic carboxylic acids are good in yellowing resistance, but their color-producing ability at low temperatures, resistance to water or plasticizers and light fastness still cannot be considered sufficient.

A variety of multi-valent metal-modified products of salicylic acid copolymers have been proposed as color-developing agents for pressure-sensitive copying paper sheets. Of these, multi-valent metal-modified products of salicylic acid resins which comprise salicylic acid and styrenes, as disclosed in Japanese Patent Laid-Open No. 112537/1988, have resin softening points of as low as 45° C. or below and, hence, have defects in coating applicability. Metal-modified products of polybenzyl salicylic acid, as disclosed in Japanese Patent Laid-Open No. 1328571988, are still insufficient to improve the yellowing problem caused by sunlight, etc., and all of the compounds illustrated in its examples have softening points of 100° C. or above and their color producing speeds are low. Multi-valent metal-modified products of salicylic acid resins, as disclosed in Japanese Patent Laid-Open Nos. 77575/1989 and 56724/1989, raise no problems in color producing performance, light fastness and coating applicability, but they involve an odor or smell which creates disadvantages in the fabrication, storage and use of the resultant color developing sheets.

In view of these situations, it is desirable to develop a well-balanced pressure-sensitive paper system which meets the requirements of color-producing ability, light fastness and coating applicability and, in addition, whose coated paper sheets have no discernable smell.

BROAD DESCRIPTION OF THE INVENTION

A first object of this invention is to provide a multi-valent metal-modified product of salicylic acid copolymer which has little or no smell and is suitable for use as a color-developing agent for pressure-sensitive copying paper sheets.

A second object of this invention is to provide a production process for the above-described multi-valent metal-modified product of salicylic acid copolymer.

A third object of this invention is to provide an excellent color-developing agent for pressure-sensitive copying paper sheets which makes use of the above multi-valent metal-modified product of salicylic acid copolymer.

A fourth object of this invention is to provide an excellent color-developing sheet for pressure-sensitive copying paper which makes use of the above color-developing agent.

The present invention provides:

(a) an almost odorless multi-valent metal-modified product of salicylic acid copolymer which is obtained by a process composed of the following successive reactions: condensing salicylic acid with a benzyl halide represented by the formula (I):

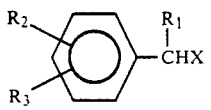

(I)

wherein $R_1$ is a hydrogen atom or an alkyl group having 1 to 4 carbons, $R_2$ and $R_3$ are individually a hydrogen atom or an alkyl, aralkyl, aryl or cycloalkyl group having 1 to 12 carbons, and X is a halogen atom to produce a first resin, reacting the first resin with a styrene derivative represented by the formula (II):

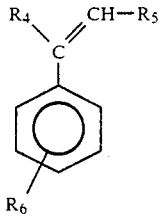

(II)

wherein $R_4$ and $R_5$ are individually a hydrogen atom or a methyl group and $R_6$ is a hydrogen atom or an alkyl group having 1 to 4 carbons, to produce a second resin, and reacting the second resin with a multi-valent metal salt;

(b) an odorless multi-valent metal-modified product of salicylic acid copolymer obtained by the complete removal of volatile matters from the aforesaid almost odorless multi-valent metal-modified product of salicylic acid copolymer;

(c) a process for producing the aforesaid almost odorless multi-valent metal-modified product of salicylic acid copolymer;

(d) a process for producing the aforesaid odorless multi-valent metal-modified product of salicylic acid copolymer;

(e) a color-developing sheet for pressure-sensitive copying paper which contains the aforesaid almost odorless multi-valent metal-modified product of salicylic acid copolymer; and (f) a color developing sheet for pressure-sensitive copying paper which contains the aforesaid odorless multi-valent metal-modified product of salicylic acid copolymer.

The color-developing sheet making use of the color-developing agent of the invention has either comparable or superior color-producing properties as compared with color-developing sheets made use of an inorganic solid acid or p-phenylphenol novolak resin. Further, its yellowing resistance to sunlight is improved to a large extent and its handling and storage capabilities are significantly advantageous.

When compared with metal salts of salicylic acid compounds which are typical as metal salts of aromatic carboxylic acids, the multi-valent metal-modified product of salicylic acid copolymer of the invention can improve the following conventionally known defects of the metal salts of aromatic carboxylic acids as color-developing agents:

(i) insufficient compatibility with non-volatile oils in which colorless dyestuff precursors are dissolved, (ii) a little solubility in water, (iii) fading of produced color marks by light, and (iv) expensiveness.

Moreover, the multi-valent metal-modified product of salicylic acid copolymer of the invention does not give off any smell or odor, which has been a problem of color-developing agents of salicylic acid resin basis, and it exhibits satisfactory color-producing ability, light fastness and coating applicability. Thus, the multi-valent metal salt of salicylic acid copolymer of the invention can provide a well-balanced pressure-sensitive paper system.

DETAILED DESCRIPTION OF THE INVENTION AND PREFERRED EMBODIMENTS

Figure 1:
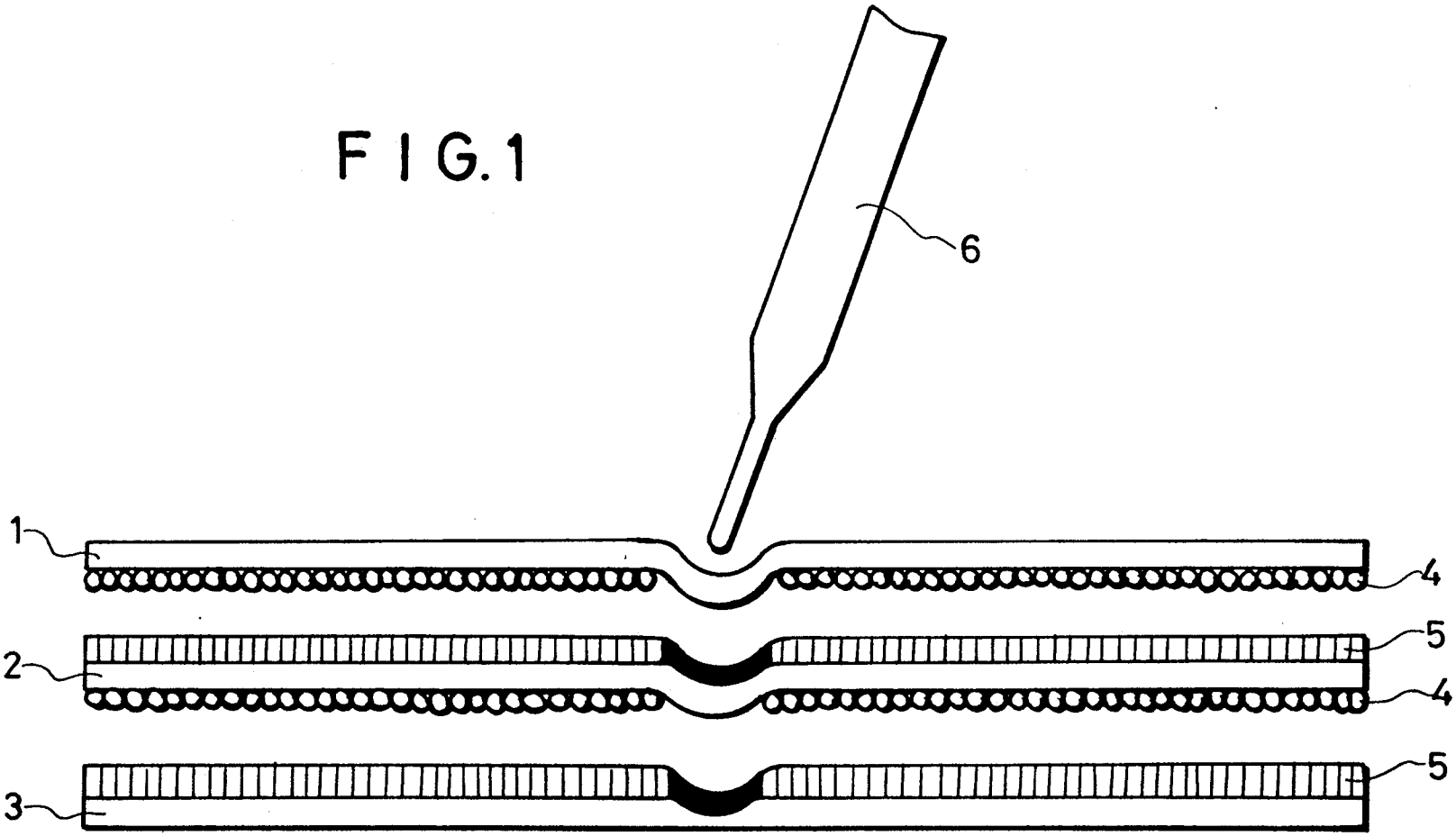
FIG. 1 illustrates the structure of a pressure-sensitive copying paper sheet.

The multi-valent metal-modified product of salicylic acid copolymer of the invention is produced by reacting salicylic acid with a benzyl halide represented by the formula (I)

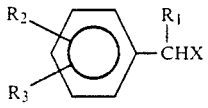

(I)

wherein $R_1$, is a hydrogen atom or an alkyl group having! 1 to 4 carbons, $R_2$ and $R_3$ are individually an alkyl, aralkyl, aryl or cycloalkyl group having 1 to 12 carbons, and X is a halogen atom, in the presence of a Friedel-Crafts catalyst to produce a first resin (hereinafter referred to as the first stage reaction), then reacting the first resin with a styrene derivative represented by the general formula (II):

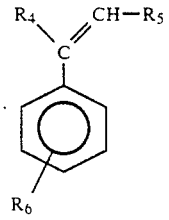

(II)

wherein $R_4$ and $R_5$ are individually a hydrogen atom or a methyl group and $R_6$ is a hydrogen atom or an alkyl group having 1 to 4 carbons, in the presence of a strong acid catalyst to produce a second resin (hereinafter referred to as the second stage reaction), and thereafter reacting the second resin with a multi-valent metal salt (hereinafter referred to as the third stage reaction).

The purpose of the first stage reaction is to obtain a co-condensation resin by causing a benzyl halide represented by the formula (I) to react with salicylic acid in the presence of a Friedel-Crafts catalyst.

It has been found that when a benzyl halide is used in an amount of 1.5 moles or more per mole of salicylic acid and the benzyl halide and salicylic acid are reacted at a reaction temperature of 20° C. or higher using a Friedel-Crafts catalyst, the benzyl group or groups can be introduced to one or both positions ortho to and/or the position para to the hydroxyl group of salicylic acid. Moreover, excess benzyl halide undergoes successive condensation with the benzyl groups introduced in salicylic acid while undergoing concurrent self-condensation, thereby forming a resinous substance.

In the starting benzyl halides, the nuclei of the benzyl groups are either unsubstituted or substituted with at least one $C_{1-12}$ alkyl, aralkyl, aryl or cycloalkyl group at an o- or m- position and/or the p-position and a hydrogen atom or $C_{1-4}$ lower alkyl group is contained at the α-position. As halogens, chlorine, bromine and fluorine are examples with chlorine being preferred.

Illustrative examples of the benzyl halide are benzyl chloride, benzyl bromide, o-methylbenzyl chloride, m-methylbenzyl chloride, p-methylbenzyl chloride, o-ethylbenzyl chloride, m-ethylbenzyl chloride, p-ethylbenzyl chloride, o-isopropylbenzyl chloride, p-n-propylbenzyl chloride, p-tertbutylbenzyl bromide, p-nonylbenzyl chloride, o-phenylbenzyl fluoride, p-cyclohexylbenzyl chloride, p-(benzyl)benzyl chloride, p-(α-methylbenzyl)benzyl chloride, p-(αα, dimethyl)-benzyl chloride, 2,3-dimethylbenzyl fluoride, 2,4-dimethylbenzyl chloride, 2,5-dimethylbenzyl chloride, 2,6-dimethylbenzyl chloride, 3,4-dimethylbenzyl chloride, 3,5-dimethylbenzyl chloride, 2,4-diethylbenzyl chloride, 3-methyl-4-ethylbenzyl chloride, 3-(α-methylbenzyl-4-methylbenzyl chloride, 4-(2,5-dimethylbenzyl)benzyl chloride, α-methylbenzyl chloride, α-ethylbenzyl bromide, α-isopropylbenzyl chloride, α-n-butylbenzyl chloride, o-methyl-α-methylbenzyl chloride, p-methyl-α-methylbenzyl chloride, m-methyl-α-methylbenzyl chloride, p-ethyl-α-methylbenzyl chloride, o-ethyl-α-methylbenzyl chloride, p-isopropyl-α-methylbenzyl chloride, p-phenyl-α-methylbenzyl chloride, p-(α-methylbenzyl)-α-methylbenzyl chloride, p-(α, α-dimethylbenzyl)-α-methylbenzyl chloride, 2,3-dimethyl-α-methylbenzyl chloride, 2,4-dimethyl-α-methylbenzyl chloride, 2,5-dimethyl-α-methylbenzyl chloride, 3,4-dimethyl-α-methylbenzyl chloride, 2-methyl-5-tert-butyl-α-methylbenzyl chloride, etc. It should, however, be borne in mind that the present invention is not necessarily limited to the use of the above specific benzyl halides. Among the above-mentioned benzyl halides, benzyl chloride, p-methylbenzyl chloride, α-methylbenzyl chloride and p-methyl-α-methylbenzyl chloride are preferred.

In the production of the co-condensation resins of the invention, the various benzyl halides can used in an amount of 1.5 to 10 moles per mole of salicylic acid.

Examples of catalysts useful in this reaction are Lewis acid catalysts, such as, ferric chloride, zinc chloride, aluminum chloride, stannic chloride, titanium tetrachloride and boron trifluoride; perfluoroalkanesulfonic acids known as super strong acids, for example, trifluoromethane-sulfonic acid; and "Nafion H" (trade name; product of E. I. du Pont de Nemours & Co., Inc.) as a perfluoroalkanesulfonic acid resin. Among these catalysts, zinc chloride is particularly preferred. The catalyst can be used in an amount of 0.05 to 200 mole percent based on salicylic acid, with 1 to 100 mole percent being preferred from the viewpoint of economics. In the process of the invention, the metal species of the catalyst employed in the reaction reacts with the salicylic acid resin when the catalyst is neutralized with a base in the reaction mixture subsequent to the second stage reaction, whereby the metal species of the catalyst is obtained as the metal-modified product of the salicylic acid resin. This is also another advantageous feature of the process of this invention. The process is economical because the catalyst is effectively used and its processing and/or treatment as a waste material is unnecessary.

The first stage reaction is usually carried out in the absence of solvent. The reaction can, however, be conducted by using a solvent. Illustrative examples of such solvent includes those solvents which are inert to the reaction; for example, ethyl ether, ethylene glycol dimethyl ether, methylene chloride, 1,2-dichloroethane, 1,1,2-trichloroethane, acetic acid, propionic acid, carbon disulfide, nitromethane and the like.

From the viewpoint of economics, these solvents are best used in an amount of 30 or less times by volume/-weight as much as the total weight of the starting materials.

Upon practice of the first stage reaction, the reaction temperature can be in the range of 20° to 180° C., preferably 50° to 160° C. The reaction time can be from 1 to 30 hours.

As a procedure for producing a resin by the above reaction, usually all of the starting materials is charged at once and then heated in situ so as to react them at a predetermined temperature; or, as an alternative, salicylic acid and the catalyst are charged and then the reaction is conducted at a predetermined temperature while adding dropwise the other starting material, i.e., benzyl halide. Here, the time of the dropwise addition can preferably account for at least 50 percent of the overall reaction time and usually ranges from 1 to 20 hours.

In the procedure where no solvent is used, the catalyst used in the first stage reaction can successively be used in the second stage reaction after completion of the first stage reaction. When it is used in a very small amounts, the first stage reaction system can directly be moved to the second stage reaction. When the catalyst used in the first stage reaction is not used in the second stage reaction, the catalyst is removed by causing the reaction mixture to dissolve in a water-insoluble solvent, adding water to the resultant solution for washing, and allowing the resultant mixture to separate into two layers, the catalyst being dissolved in the water layer. In the procedure where a solvent is used, the first stage reaction system as is can directly be moved to the second stage reaction in the same manner. Alternatively, the second stage reaction can be conducted by washing the reaction mixture with water to remove the catalyst therefrom and adding a further catalyst to the resultant reaction mixture.

In the second stage reaction, the co-condensation resin obtained in the first stage reaction is caused to react with the styrene derivative represented by the general formula (II) in the presence of a strong acid catalyst.

In this reaction, the styrene derivative acts at the α-position thereof on one more aromatic substituents of the salicylic acid resin obtained in the first-stage reaction, thereby introducing the corresponding number of benzyl groups into the resin. In other words, the styrene derivative reacts at the α-position thereof with one or more benzene rings other than the skeletal benzene ring of salicylic acid.

In addition, an excess portion of the styrene derivative also reacts with the aromatic substituents of the salicylic acid resin and also with benzene rings of the styrene derivative bonded to such aromatic substituents, whereby the molecular weight increases.

Illustrative examples of the styrene derivative useful in the second-stage reaction are: styrene, o-methylstyrene, m-methylstyrene, p-methylstyrene, o-ethylstyrene, p-ethylstyrene, o-isopropylstyrene, m-isopropylstyrene, p-isopropylstyrene, p-tert-butylstyrene, α-methylstyrene, α-methylstyrene, β-methylstyrene and so on. It should, however, be borne in mind that the present invention is not necessarily limited to the use of the above exemplified specific styrene derivatives. It is economical styrene that is preferable from the industrial standpoint.

The styrene derivative can be used in an amount of 0.2 to 20 moles, preferably 0.5 to 10 moles, per mole of salicylic acid which is contained in the resin obtained in the first-stage reaction. If the styrene derivative is used in an amount smaller than the lower limit specified in the present invention, a color-developing agent containing a metal-modified product of the resulting resin has somewhat insufficient miscibility with a non-volatile oil in microcapsules on a CB-sheet of the above-mentioned copying paper and water insolubility. On the other hand, an amount greater than the upper limit results in a decrease of the relative proportion of salicylic acid and the density of the color to be produced will not reach the desired level.

In this second-stage reaction, a strong acid catalyst is used. Illustrative examples of the strong acid catalyst include mineral acids such as hydrochloric acid, sulfuric acid and phosphoric acid, Friedel-Crafts catalysts such as ferric chloride, zinc chloride, aluminum chloride, stannic chloride, titanium tetrachloride and boron trifluoride, methanesulfonic acid, trifluoromethanesulfonic acid, etc. It is inexpensive sulfuric acid that is particularly preferable among these examples of strong acid catalysts. The catalyst can be used in an amount of 0.05 to 200 weight percent based on the total weight of the salicylic acid resin obtained in the first-stage reaction and the styrene derivative, with 1 to 100 weight percent being preferable from the standpoint of economics.

Further, a solvent can also be used in the second-stage reaction. Illustrative examples of the solvent include those inert to the reaction; for example, aliphatic hydrocarbons such as n-hexane, n-heptane, n-pentane and cyclohexane; ethers such as ethyl ether and ethylene glycol dimethyl ether; esters such as ethyl acetate and butyl acetate; halogenated hydrocarbon solvents such as methylene chloride, 1,2-dichloroethane, 1,1,2-trichloroethane, carbon tetrachloride, chloroform and monochlorobenzene; organic acids such as acetic acid and propionic acid; ketones such as acetone and methyl ethyl ketone; and in addition, carbon disulfide, nitromethane, acetonitrile, tetrahydrofuran and the like.

From an economical standpoint, it is desirable to use such a solvent in an amount which is not more than 30 times by volume/weight the total weight of the starting materials.

The reaction temperature upon practice of the second-stage reaction can range from −20° to 100° C., preferably, from 0° to 50° C. The reaction time can be in a range of 1 to 30 hours.

As a procedure for producing the resin by the second-stage reaction, it is usual to add a catalyst to an organic solvent solution of the salicylic acid resin obtained in the first-stage reaction and then to react the further starting material, i.e., the styrene derivative, with the salicylic acid resin at a predetermined temperature while adding the styrene derivative dropwise. Here, the time of the dropwise addition preferably accounts for at least 50 percent of the whole reaction time and usually ranges from 1 to 20 hours. When the solvent used is insoluble in water, water can be added to the reaction mixture after the reaction. After washing the reaction mixture with the water and allowing the resultant mixture to separate into two layers, the solvent can be distilled off to obtain the resin. As an alternative, the resin can be extracted out with a dilute aqueous alkali solution for use in the next step. Where the solvent is soluble in water, the reaction mixture can be poured into water and the resin can then be obtained as a precipitate.

The salicylic acid resin thus-obtained consists of 5 to 35 mole percent of the salicylic acid moiety, 10 to 85 mole percent of the benzyl moiety derived from the general formula (I) and 4 to 85 mole percent of the styrene moiety of the general formula (II). Its weight average molecular weight falls within a range of 500 to 10,000 with a range of 500 to 5,000 being preferred for use as a color-developing agent.

The multi-valent metal-modified products of the above-described salicylic acid resins are described next. As described above, the term "multi-valent metal-modified product of a salicylic acid resin" as used herein means either a multi-valent metal salt of the salicylic acid resin or a molten mixture containing the multi-valent metal salt.

Several known processes can be used to produce a multi-valent metal salt of the salicylic acid resin described above. For example, it can be produced by reacting an alkali metal salt of the resin and a water-soluble multi-valent metal salt in water or in a solvent in which the alkali metal salt and water soluble multi-valent metal salt can be dissolved. Namely, the multi-valent metal salt can be formed by reacting the hydroxide, the carbonate or an alkoxide of an alkali metal with the salicylic acid resin to obtain the alkali metal salt of the salicylic acid resin, an aqueous solution thereof, an alcohol solution thereof, or a water-alcohol mixed solution thereof, and then reacting a water-soluble multi-valent metal salt further.

Specifically, the copolymer is dispersed in an aqueous solution, alcohol solution or water-alcohol solution containing the hydroxide, the carbonate or an alkoxide of an alkali metal in an amount at least equivalent to carboxyl groups in the salicylic acid copolymer, whereby the copolymer is dissolved at 0° to 100° C. A water-soluble multi-valent metal salt is then added as is or as an aqueous solution, alcohol solution or water-alcohol solution, and is then reacted with the aforesaid solution at 0° to 100° C., so that the multi-valent metal salt of the salicylic acid copolymer is obtained as a precipitate. It is desirable to react the water-soluble multi-valent metal salt in an amount of about 0.5 to 1 equivalent, relative to the carboxyl groups in the salicylic acid copolymer.

In order to obtain a molten mixture containing a multi-valent metal salt of a salicylic acid resin, the salicylic acid resin is mixed with a multi-valent metal salt of an organic carboxylic acid such as formic acid, acetic acid, propionic acid, valeric acid, caproic acid, stearic acid or benzoic acid; heating and reacting them in a molten state; and then cooling the resultant mixture. In some instances, a basic substance, for example, ammonium carbonate, ammonium bicarbonate, ammonium acetate or ammonium benzoate can be added in addition, to be followed by heating and reaction in a molten state.

A molten mixture containing a multi-valent metal salt of a salicylic acid resin can also be obtained by mixing the salicylic acid resin and the carbonate, oxide or hydroxide of a multi-valent metal, heating them together with a basic substance, e.g., the ammonium salt of an organic carboxylic acid such as ammonium formate, ammonium acetate, ammonium caproate, ammonium stearate or ammonium benzoate; reacting the resultant mixture in a molten state; and then cooling the reaction mixture.

When the metal-modified product of the salicylic acid resin is produced by heating and melting the resin and multi-valent metal salt, the melting is conducted usually at 100° to 180° C., and the reaction time is about 1 to several hours, although it varies depending on the composition of the resin, the melting temperature and the kind and amount of the multi-valent metal salt used. Further, the multi-valent metal salt can desirably be used as an organic carboxylic acid salt thereof or the carbonate, oxide or hydroxide thereof in an amount such that the multi-valent metal is contained in an amount of 1 weight percent to about 20 weight percent based on the total weight of the salicylic acid resin.

Although no specific limitation is imposed on the amount of the basic substance to be used, it can generally be used in an amount of 1 to 15 weight percent based on the total weight of the resin. When the basic substance is used, it is more preferable to use it after mixing same in advance with the multi-valent metal salt.

The softening points of the metal-modified resins produced by the heating and melting method fall within a range of 50° to 120° C.

Illustrative examples of the metal of the metal-modified product of salicylic acid resin of the invention can embrace metals other than alkali metals such as lithium, sodium and potassium. Preferable multi-valent metals, are calcium, magnesium, aluminum, copper, zinc, tin, barium, cobalt, nickel and the like. Among these, zinc is particularly effective.

Although the multi-valent metal-modified product of the salicylic acid resin thus-obtained has almost no smell, it still seems to give off a delicate smell of unreacted monomer or origomer components originated from the styrene derivative used as a raw material. The odor from these components is present to such a minimal or miniscule degree as to create substantially no problems upon fabrication or use of color-developing sheets.

The smell cannot be removed by the method of treating the product under vacuum while it is heated and molten for the removal of volatile matters as practiced conventionally.

However, according to the process for producing a second type of the multi-valent metal-modified product of salicylic acid resin of this invention, trace amounts of the smelling components can be removed.

Specifically, water is added dropwise to the multi-valent metal-modified product of salicylic acid resin obtained in the third stage reaction, in a molten state at a temperature above the boiling point of water to remove the smelling components as well as to distill water out of the system. In this case, it is preferable to maintain the temperature at 100° to 160° C., particularly 120° to 150° C. The rate of the dropwise addition of water is preferably kept constant so as to equalize the amount of water dropped to the amount of water vaporized. The amount of water dropped in is approximately 1/10 to 1 fold by weight as much as the multi-valent metal-modified product of salicylic acid resin. This method should be practiced under stirring and is preferably carried out in the stream of an inert gas such as gaseous nitrogen. The water vapor containing the evaporated smelling components is condensed by a cooler and trapped out of the system. The dropwise addition is to be ended at the moment when no smell is realized in the inert gas or the like being discharged to the outside of the system.

As quantitative methods for determining smells, there are the methods of mechanical (instrumental) analysis and the organoleptic testing method in dilute solutions which are commonly in wide use. However, these methods are not suited to the metal-modified resin of the invention.

Therefore, the determination of the smell or odor of the metal-modified resin of this invention is expressed in a four-grade evaluation by directly smelling a ground product of the metal-modified resin. In the four-grade expression, the smaller the number, the less the smell, and hence zero means no smell or odor. All of the compounds of the invention correspond to odor ranks of 0 to 1.

The majority of the metal-modified resins produced according to the process of the invention have softening points ranging from 50° to 90° C. However, those having softening points outside of the range can also be produced when their color producing speeds do not raise serious problems.

It should be noted that the softening point affects the color producing speed. When the softening point is high, instantaneous color producing speed is low for forming copy marks by a ballpoint pen, etc. This fact seems to give a visual impression of inferiority to users. When confirmation of copy marks like a signature immediately after its writing stroke takes more than a reasonable time of about 10 seconds, presence or degradation of the copying function is called into question. There is no quantitative method for evaluating the instantaneous color producing speed. However, it can be evaluated to some extent from the density of produced color measured 1 minute 30 seconds after a typewriter impression. This method is adopted as an evaluation method in the invention. In this method, the stronger the density of produced color measured after a time passage of 1 minute 30 seconds, the faster the color producing speed.

As the softening point becomes lower, the color producing speed tends to be faster. However, softening points that are too low make the pulverization impossible and hence are not favorable. Consequently, the softening points (as measured by the ring and ball softening point measuring method prescribed in JIS K-2548; measurements of the softening points are all dependent on this method hereunder), which meet desired color producing speeds and do not affect adversely the pulverization by grinding, fall within a range of about 50° to 90° C.

Since the multi-valent metal-modified product of the salicylic acid copolymer of the invention takes a structure in which an alkyl group is contained at the $\alpha$-position of the benzyl group by the reaction with the styrene derivative as described above, color-developing sheets using this product have improved yellowing resistance.

The multi-valent metal-modified products of salicylic acid copolymers obtained in accordance with the various processes described above have excellent properties as color developing agents. In order to use the metal-modified product as a color-developing agent, it is recommendable to grind it into suitable sizes of particulates by means of a sand grinding mill or the like. In practical use, the color developing agent can preferably be suspended or dissolved in a solvent, as desired.

The color-developing agent can also be used in combination with one or more known color-developing agents; namely, inorganic solid acids such as activated clay, organic polymers such as phenol-formaldehyde resin and metal salts of aromatic carboxylic acids. The color-developing agent can further be used in combination with at least one of the oxide, hydroxide and carbonate of a multi-valent metal selected from the group consisting of zinc, magnesium, aluminum, lead, titanium, calcium, cobalt, nickel, manganese and barium.

As a method for the fabrication of a color-developing sheet for pressure-sensitive copying paper by using the multi-valent metal-modified product of salicylic acid resin of the invention, any one of the following methods can be employed: (1) to apply a water-base coating formulation, which makes use of an aqueous suspension of the metal-modified product, to a base material such as paper web: (2) to incorporate the metal-modified product in a base paper web when the base paper web is produced: and (3) to coat a base material with a solution or suspension of the metal-modified product in an organic solvent.

To form a layer of the color-developing agent on a base material such as paper web by coating, the color-developing agent preferably has suitable viscosity and coating applicability. It is used as a coating formulation with suitable viscosity and coating applicability by suspending it in water or dissolving or suspending it in a solvent as described in (1) and (3) above and thereafter by incorporating therein kaolin clay or its homolog clay, calcium carbonate, starch, synthetic or natural latex, etc. The proportion of the color-developing agent in the coating formulation preferably is 10 to 70 percent of the whole solids. If the proportion of the color-developing agent is smaller than 10 percent, it is impossible to exhibit sufficient color-producing ability. Any proportions greater than 70 percent result in color-developing sheets having poor paper surface characteristics. The coating formulation can be applied at a rate of 0.5 g/m$^2$ or more, preferably 1 to 10 g/m$^2$ in terms of dry weight.

This invention is illustrated in detail by the following examples.

Judgment of Smell

In a rotary sample mill (model SK-M 10) manufactured by Kyoritsu Riko K. K., 30 g of the multi-valent metal-modified resin synthesized in each of examples and comparative examples below was ground for 30 seconds, and the smell thereby given off was immediately judged and compared. The judgment was made in a four-grade evaluation, the ranks of which are as follows:

3. smelling strongly
2. smelling
1. smelling very slightly
0. no smell

Determination of performance of color developing sheets

The following methods were relied upon for the determination of performance of color-developing sheets for pressure-sensitive copying paper obtained in each of examples and comparative examples below. The results are summarized in Table 2.

1. Color-producing speed and produced color density (conducted in air-conditioned rooms of 5° C. and 60 percent R.H. and 20° C. and 65 percent R.H.)

Using a commercial blue-color producing CB-sheet containing Crystal Violet Lactone (CVL) as a principal pressure-sensitive dyestuff precursor ("NW-40T", trade name; product of Jujo Paper Co., Ltd.), a sample color-developing sheet (CF-sheet) coated with a water-base coating formulation was stacked with their coated sides maintained in contiguous relation. The thus-stacked pressure-sensitive copying paper was typed by an electronic typewriter to produce a color. Its reflectance was measured one minute 30 seconds after the typing and 24 hours after the typing. The results are expressed in terms of the Y value.

2. Light fastness of produced color marks

Each sample color-developing sheet, which had produced a color in the manner described above in the testing method 1, was exposed for 2 hours (and for 4 hours) to light on a carbon arc fade meter (manufactured by Suga Testing Machine Co., Ltd.). After the exposure, its reflectance was measured by the "Σ-80 Color Difference Meter". The results are expressed in terms of the Y value.

The smaller the Y value and the smaller its difference from the Y value before the test, the less the fading by the light and the more preferable the product.

3. Plasticizer resistance

DOP microcapsule coated paper sheets were prepared by forming microcapsules, which contained dioctyl phthalate (DOP) as a core substance, had an average capsule size of 5.0 $\mu$m, and were equipped with melamine-formaldehyde resin capsule walls, adding a small amount of a starch-type liquid binder, applying the thus-prepared coating formulation by an air-knife coater on a high-quality paper web to achieve a dry coat weight of 5 g/m$^2$ and then drying the thus-coated paper web. One of the DOP microcapsule coated paper sheets and the color-developing sheet with color marks produced above in the testing method 1 were brought into contiguous relation with their coated sides facing each other. They were thereafter caused to pass under a linear pressure of 100 kg/cm through a super calendar roll so that DOP was allowed to penetrate uniformly into the colored surface.

One hour after the test, the reflectance of the color-developing sheet was measured by the "Σ-80 Color Difference Meter". The results are expressed in terms of the Y value. The smaller the Y value and the smaller its difference from the Y value before the test, the better the plasticizer resistance of the produced color marks.

4. Waterproofness of produced color marks

Each sample color-developing sheet, which had been colored by the testing method 1, was dipped in water for 2 hours. Density changes of the produced color marks were observed visually.

5. Yellowing property of color-developing sheets 5-1 Yellowing by $NO_x$

Following JIS L-1055 (Testing Method for NOx Gas Fastness of Dyed Materials and Dyes), each sample color-developing sheet was stored for 1 hour in a closed vessel of an atmosphere of $NO_x$ occurred by the reaction of $NaNO_2$ (sodium sulfite) and $H_3PO_4$ (phosphoric acid). The degree of its yellowing was investigated.

Upon an elapsed time of 1 hour after completion of the storage, the reflectance of the color-developing sheet was measured by the "Σ-80 Color Difference Meter". The measurement results are expressed in terms of WB value. The greater the WB value and the smaller its difference from the WB value of a sheet not exposed to $NO_x$ gas (expressed as untested sheet in Table 2), the smaller the yellowing property in an $NO_2$ atmosphere.

5-2 Yellowing by light

Each sample color-developing sheet was exposed for 4 hours to light on the carbon arc fade meter (manufactured by Suga Testing Machine Co., Ltd.). After the exposure, the reflectance of the sample color-developing sheet was measured by the "Σ-80 Color Difference Meter". The measurement results are expressed in terms of WB value. The greater the WB value and the smaller its difference from the WB value of an unexposed sheet (expressed as untested sheet in Table 2), the smaller the yellowing property upon exposure to light.

EXAMPLE 1

(a) Synthesis of salicylic acid resin and its multi-valent metal-modified product Charged in a glass-made reactor were 27.6 g (0.2 mole) of salicylic acid, 55.7 g (0.44 mole) of benzyl chloride, and 0.3 g (0.0002 mole) of anhydrous zinc chloride (purity : 90 percent) as a catalyst. Under a nitrogen gas stream, the reactants were subjected to condensation for 3 hours at a reaction temperature of 70° to 100° C. The contents were then heated to 120° C., at which temperature they were aged for 5 hours. The first stage reaction was thus completed.

Subsequently, 136 g of 1,2-dichloroethane were charged in the glass-made reactor to dissolve the resin formed by the reaction and the contents were cooled to a temperature of 0° to 2° C. Then, 7.2 g of 95 percent sulfuric acid was added thereto, followed by dropwise addition of 83.2 g (0.8 mole) of styrene over 6 hours at the same temperature while stirring vigorously. Thereafter, the contents were aged at the same temperature for 2 hours, thereby completing the second stage reaction.

Then, the reaction solution was added with 100 g of water and neutralized with 28 percent aqueous ammonia to pH 6. Thereafter, the resultant reaction mixture was allowed to stand to obtain a lower organic layer, which was then raised in temperature by heating to distill out the solvent, 1,2-dichloroethane. At the moment when the temperature reached 130° C., the organic layer was maintained under vacuum for 30 minutes by an aspirator. After returning the pressure back to atmospheric, 10 g of zinc hydroxide was added to the resultant organic layer and heated to 145° C., at which temperature the mixture was stirred for 30 minutes. Thus, the third stage reaction was completed.

After the reaction, the contents were poured into a porcelain dish to obtain a zinc-modified product of the salicylic acid resin as a lemon yellow material. The yield was 147 g, the weight average molecular weight was 1,100, and the softening point was 82.5° C. Regarding the smell of the zinc-modified resin, it gave a rank of 1 corresponding to "smelling very slightly".

(b) Use as a color-developing agent

Using the zinc-modified product of the salicylic acid resin as a color-developing agent, it was dispersed in accordance with the following composition by a sand grinding mill so as to prepare a suspension.

| | Parts by weight |
|---|---|
| Color-developing agent | 6 |
| 10% Aq. PVA solution (PVA: "Kuraray #117", product of Kuraray Co., Ltd.) | 3 |
| Water | 22.5 |

Then, a coating formulation of the following composition was prepared by using the above suspension of the color-developing agent.

| | Parts by weight |
|---|---|
| Suspension | 10 |
| Light calcium carbonate | 10 |
| Starch | 0.8 |
| Synthetic rubber latex | 0.8 |
| Water | 32.5 |

The coating formulation was applied on a high quality paper web to give a dry coat weight of 5.0 to 5.5 g/m$^2$ and was then dried, thereby obtaining color-developing sheets.

EXAMPLES 2 TO 7

The first to third stage reactions were conducted in the same manner as in Example 1 under the conditions given in Table 1 to obtain a variety of metal-modified products of salicylic acid resins, from which color-developing sheets were obtained also in the same manner as in Example 1.

TABLE 1

Production of Vaious Metal-Modified Salicylic Acid Resins

| | First stage reaction | | | | | |
|---|---|---|---|---|---|---|
| | Starting material | | | | | |
| Example | Salicylic acid g (mole) | Benzyl halide kind | Benzyl halide g (mole) | Catalyst kind | Catalyst g (mole) | Conditions temp./time (°C./hr) |

TABLE 1-continued

| Production of Vaious Metal-Modified Salicylic Acid Resins | | | | | | |
|---|---|---|---|---|---|---|
| 2 | 27.6 (0.2) | α-methyl-benzyl chloride | 61.9 (0.44) | zinc chloride | 0.75 (0.005) | 70-100/5 |
| 3 | 27.6 (0.2) | α-methyl-benzyl chloride | 98.4 (0.7) | zinc chloride | 1.5 (0.01) | 70-100/5 |
| 4 | 27.6 (0.2) | p-methyl-α-methyl-benzyl chloride | 46.4 (0.3) | zinc chloride | 0.75 (0.005) | 70-100/3 |
| 5 | 27.6 (0.2) | 3,5-dimethyl-benzyl chloride | 61.8 (0.4) | aluminum chloride | 0.07 (0.0005) | 70-90/3 |
| 6 | 27.6 (0.2) | benzyl chloride | 55.7 (0.44) | zinc chloride | 0.75 (0.005) | 90-100/3 |
| 7 | 27.6 (0.2) | benzyl chloride | 55.7 (0.44) | stannic chloride | 0.26 (0.001) | 70-90/3 |

| | Second stage reaction | | | | | | |
|---|---|---|---|---|---|---|---|
| | Starting material | | | | | | Condition temp./dropping time + aging time |
| | Styrene | derivative | Catalyst | | Solvent | | |
| Example | kind | g (mole) | kind | g | kind | g | (°C./hr + hr) |
| 2 | styrene | 83.2 (0.8) | 95% sulfuric acid | 7.2 | 1,2-dichloro-ethane | 136 | 0-5/5 + 3 |
| 3 | p-methyl-styrene | 35.4 (0.3) | 95% sulfuric acid | 7.2 | 1,2-dichloro-ethane | 136 | 0-5/5+ 3 |
| 4 | styrene | 156 (1.5) | 95% sulfuric acid | 3.6 | methylene chloride | 200 | 10-20/8 + 2 |
| 5 | styrene | 83.2 (0.8) | 95% sulfuric acid | 7.2 | 1,2-dichloro-ethane | 136 | 0-5/5 + 3 |
| 6 | α-methyl-styrene | 23.6 (0.2) | 95% sulfuric acid | 21.6 | 1,2-dichloro-ethane | 136 | 0-5/5 + 3 |
| 7 | styrene | 83.2 (0.8) | 95% sulfuric acid | 7.2 | 1,2-dichloro-ethane | 136 | 0-5/5 + 3 |

| | Third stage reaction | | | Multi-valent metal-modified salicylic acid resin | | | |
|---|---|---|---|---|---|---|---|
| | Starting Material | | Conditions | | | | |
| Example | Multi-valent metal kind | salt g (mole) | temp./time (°C./hr) | Yield g | Softening point °C. | Average molecular weight | Judgement of smell |
| 2 | zinc oxide | 8.2 (0.1) | 135-145/1 | 157 | 76 | 920 | 1 |
| 3 | zinc benzoate | 26 (0.08) | 140-150/1 | 160 | 73 | 750 | 1 |
| 4 | zinc oxide | 8.2 (0.1) | 120-145/2 | 117 | 81 | 1800 | 1 |
| 5 | nickel acetate tetrahydrate | 15 (0.06) | 135-150/5 | 156 | 77 | 740 | 1 |
| 6 | zinc benzoate | 26 (0.08) | 135-145/1 | 112 | 59 | 640 | 1 |
| 7 | magnesium hydroxide | 5.8 (0.1) | 135-145/1 | 148 | 80 | 1080 | 1 |

EXAMPLE 8

Fifty grams of the zinc-modified product of the salicylic acid resin obtained in Example 1 was molten by heating in a stream of gaseous nitrogen. The molten zinc-modified resin was added with 5 g of water dropwise over 2 hours while being heated at a temperature of 120° to 140° C. under stirring. In the meantime, vaporized water vapor was trapped out by way of a cooler. After completion of the dropwise addition, the molten zinc-modified resin was maintained at the same temperature for about 1 hour until no evolution of water vapor was confirmed. The molten resin was poured out immediately and cooled to obtain a zinc-modified product of the salicylic acid resin with a softening point of 83° C. as a lemon yellow material.

The judgment of smell of the zinc-modified resin gave a rank of 0 corresponding to "no smell". Color-developing sheets were obtained in the same manner as in Example 1 from the zinc-modified resin.

EXAMPLES 9 TO 11

Experiments were carried out in the same manner as in Example 8 except for the use of the various zinc-modified products of salicylic acid resins obtained in Examples 2 to 4 in place of the zinc-modified product of the salicylic acid resin obtained in Example 1, thereby obtaining the zinc-modified resins marked ranks of 0 corresponding to "no smell". The softening points of the zinc-modified resins were 78° C., 72° C. and 81° C. in Examples 9, 10 and 11, respectively. Color-developing sheets were obtained in the same manner as in Example 1 from the zinc-modified resins obtained in these Examples.

COMPARATIVE EXAMPLE 1

Charged in a glass-made reactor were 27.6 g (0.2 mole) of salicylic acid, 44.8 g (0.4 mole) of benzyl methyl ether, and 0.76 g of p-toluenesulfonic acid and 0.76 g of anhydrous zinc chloride as catalysts. The reactants were condensed for 3 hours at 125° to 135° C. under a nitrogen gas stream. Thereafter, the reaction temperature was raised to 145° C. and the reaction was allowed to proceed further for 2 hours. The internal temperature was lowered to 70° C. and 150 ml of 1,2-dichloroethane was charged, followed by cooling to room temperature. Then, 7.5 g of 96 percent sulfuric acid was charged in the reactor, and 83.2 g (0.8 mole) of styrene were added dropwise at 20° to 30° C. over 5 hours under vigorous stirring. Thereafter, the reaction mixture was aged at the same temperature for 5 hours to complete the reaction. Under stirring, 60 g of water was added to the reaction mixture, and the resulting mixture was allowed to stand and separate into layers. The weight average molecular weight of a resin obtained here was 1,380. The lower solvent layer was charged into a separate glass-made reactor, followed by addition of 20 g of 28 percent aqueous ammonia and 8.1 g (0.1 mole) of zinc oxide. The resultant mixture was stirred for 1 hour at room temperature. Thereafter, the reaction mixture was raised in temperature to 60° to 70° C. at which temperature it was submitted to reaction for 1 hour and then heated to distill out the solvent. The internal temperature was raised to 150° C. The reaction product was degasified for 30 minutes in a vacuum of 20 mmHg and was then taken out of the reactor, thereby obtaining 156 g of a transparent zinc-modified salicylic acid resin of a reddish brown color. Its softening point was 85° C. The judgment of smell of the zinc-modified resin gave a rank of 2 corresponding to "smelling". Color-developing sheets were obtained in the same manner as in Example 1 from the zinc-modified resin.

COMPARATIVE EXAMPLE 2

Charged in a glass-made reactor were 27.6 g (0.2 mole) of salicylic acid, 24.4 g (0.2 mole) of o-methylbenzyl alcohol, and 3.0 g of p-toluenesulfonic acid as a catalyst. Under a nitrogen stream, the reactants were subjected to condensation for 3 hours at a reaction temperature of 150° to 160° C., followed by a dropwise addition of 48.8 g (0.4 mole) of α-methylbenzyl alcohol at the same temperature over 5 hours.

After the dropwise addition, the reaction mixture was aged for 2 hours at the same temperature, thereby completing the reaction. To the resultant resin in a molten state, 200 ml of toluene and 60 ml of water were added under stirring and the mixture thus-obtained was allowed to stand and separate into layers. The upper solvent layer was charged in a separate reactor, followed by addition of 9.9 g (0.1 mole) of zinc hydroxide. The resultant mixture was submitted to reaction, while being raised in temperature by heating to distill out the solvent. The internal temperature was raised to 150° C., at which temperature the reaction product was aged for 2 hours. The reaction product was degasified for 30 minutes in a vacuum of 20 mmHg and was then taken out of the reactor, thereby obtaining 85 g of a transparent zinc-modified salicylic acid resin of a lemon yellow color. The weight average molecular weight of the zinc-modified resin was 750 and its softening point was 54° C. The judgement of smell gave the resin a rank of 3 corresponding to "smelling strongly". Color-developing sheets were obtained from the zinc-modified resin in the same manner as in Example 1.

TABLE 2

Performance Test Results of Color Developing Sheets

| Example | WB value of untested sheet | $NO_x$ yellowing resistance of color developing sheet (WB value) | Light yellowing resistance of color developing sheet (WB value) | Blue color production (20° C., 65% RH): color density produced by color developing sheet (Y) 1.5 minutes later | 24 hours later | Light fastness of produced color marks (Y) 2 hours | 4 hours |
|---|---|---|---|---|---|---|---|
| 1 | 84.5 | 82.4 (2.1) | 80.4 (4.1) | 55.5 | 53.2 | 63.0 | 71.4 |
| 2 | 84.9 | 82.8 (2.1) | 82.7 (2.2) | 54.9 | 53.0 | 59.9 | 67.2 |
| 3 | 84.8 | 82.5 (2.3) | 83.1 (1.7) | 54.5 | 53.6 | 58.5 | 66.5 |
| 4 | 85.2 | 82.4 (2.8) | 83.1 (2.1) | 57.5 | 55.5 | 61.4 | 67.5 |
| 5 | 85.5 | 82.7 (2.8) | 83.0 (2.5) | 59.7 | 56.8 | 59.6 | 64.9 |
| 6 | 84.1 | 82.2 (1.9) | 83.0 (1.1) | 55.1 | 54.0 | 62.4 | 72.5 |
| 7 | 84.2 | 82.0 (2.2) | 78.2 (6.0) | 57.0 | 54.2 | 68.8 | 75.9 |
| 8 | 85.2 | 83.0 (2.2) | 80.9 (4.3) | 55.9 | 53.0 | 62.1 | 70.5 |
| 9 | 84.8 | 82.8 (2.0) | 82.5 (2.3) | 55.4 | 53.1 | 61.1 | 68.4 |
| 10 | 84.2 | 82.0 (2.2) | 82.5 (1.7) | 54.5 | 53.5 | 58.8 | 67.2 |
| 11 | 84.8 | 82.3 (2.5) | 83.0 (1.8) | 58.0 | 55.2 | 61.0 | 68.2 |
| Comp. Ex. 1 | 84.8 | 82.0 (2.8) | 82.5 (2.3) | 57.5 | 55.2 | 61.3 | 67.9 |
| Comp. Ex. 2 | 84.1 | 81.1 (2.3) | 79.9 (4.2) | 56.5 | 50.2 | 67.0 | 73.2 |

| Example | Blue color production (20° C., 65 % RH): Plasticizer resistance of produced color marks (Y) | Water resistance of produced color marks | Law-temp. color production (5° C., 60% RH): Color density produced by color developing sheet (Y) 1.5 minutes later | 24 hours later |
|---|---|---|---|---|
| 1 | 53.5 | good | 59.5 | 53.9 |
| 2 | 53.7 | good | 58.6 | 53.8 |
| 3 | 53.2 | good | 58.0 | 54.5 |
| 4 | 54.0 | good | 62.7 | 55.7 |
| 5 | 55.5 | good | 62.2 | 56.9 |
| 6 | 55.5 | good | 60.4 | 55.8 |
| 7 | 55.6 | good | 61.5 | 55.2 |
| 8 | 52.9 | good | 61.8 | 53.9 |
| 9 | 53.5 | good | 58.4 | 54.2 |
| 10 | 53.1 | good | 59.5 | 54.5 |

TABLE 2-continued

| Performance Test Results of Color Developing Sheets | | | | |
|---|---|---|---|---|
| 11 | 55.6 | good | 63.5 | 56.5 |
| Comp. Ex. 1 | 49.8 | good | 62.3 | 55.5 |
| Comp. Ex. 2 | 51.5 | good | 58.4 | 50.8 |

What is claimed is:

1. A color-developing sheet for pressure-sensitive copying paper, comprising:

(a) a base sheet containing (b) an almost odorless multi-valent metal-modified product of salicyclic acid copolymer, the multi-valent metal-modified product of salicylic acid copolymer being obtained by the process comprised of the following successive steps: condensing salicylic acid with a benzyl halide represented by the formula (I):

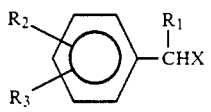

(I)

wherein $R_1$ is a hydrogen atom or an alkyl group having 1 to 4 carbons, $R_2$ and $R_3$ are individually a hydrogen atom or an alkyl, aralkyl, aryl or cycloalkyl group having 1 to 12 carbons, and X is a halogen atom, to produce a first resin, reacting the first resin with a styrene derivative represented by the formula (II):

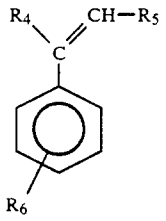

(II)

wherein $R_4$ and $R_5$ are individually a hydrogen atom or a methyl group and $R_6$ is a hydrogen atom or an alkyl group having 1 to 4 carbons, to produce a second resin, reacting the second resin with a multi-valent metal salt to the multi-valent metal-modified product of salicylic acid copolymer, and adding water dropwise to the multi-valent metal-modified product of salicylic acid copolymer at a temperature above the boiling point of water to remove volatile matters.

2. A color-developing sheet for pressure-sensitive copying paper, comprising:

(a) a base sheet; and (b) an almost odorless multi-valent metal-modified product of salicylic acid copolymer, the multi-valent metal-modified product of salicylic acid copolymer which has a softening point between 50° and 90° C., the multi-valent metal-modified product of salicylic acid copolymer being obtained by the process comprised of the following successive steps condensing salicylic acid with a benzyl halide represented by the formula (I):

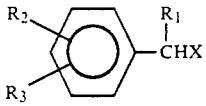

(I)

wherein $R_1$ is a hydrogen atom or an alkyl group having 1 to 4 carbons, $R_2$ and $R_3$ are individually a hydrogen atom or an alkyl, aralkyl, aryl or cycloalkyl group having 1 to 12 carbons, and X is a halogen atom, to produce a first resin, reacting the first resin with a styrene derivative represented by the formula (II):

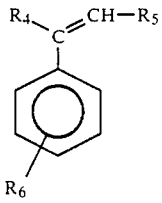

(II)

wherein $R_4$ and $R_5$ are individually a hydrogen atom or a methyl group and $R_6$ is a hydrogen atom or a an alkyl group having 1 to 4 carbons, to produce a second resin, reacting the second resin with a multi-valent metal salt to the multi-valent metal-modified product of salicylic acid copolymer, and adding water dropwise to the multi-valent metal-modified product of salicylic acid copolymer at a temperature above the boiling point of water to remove volatile matters.

3. The color-developing sheet according to claim 1 wherein the multi-valent metal-modified product of salicylic acid copolymer is in the form of a layer on a surface of base sheet (a).

4. The color-developing sheet according to claim 1 wherein the multi-valent metal-modified product of salicylic acid copolymer has been prepared by a process comprising condensing salicylic acid with a benzyl halide represented by the formula (I) at a temperature of 20° to 160° C. in the presence of a Friedel Crafts catalyst to obtain a first resin, reacting the first resin with a styrene derivative represented by the formula (II) at a temperature of 0° to 50° C. in the presence of a strong acid catalyst to obtain a second resin, and reacting the second resin with a multi-valent metal salt.

5. The color-developing sheet according to claim 2 wherein the multi-valent metal-modified product of salicylic acid copolymer is in the form of a layer on a surface of base sheet (a).

6. The color-developing sheet according to claim 2 wherein the multi-valent metal-modified product of salicylic acid copolymer has been prepared by a process comprising condensing salicylic acid with a benzyl halide represented by the formula (I) at a temperature of 20° to 160° C. in the presence of a Friedel Crafts catalyst to obtain a first resin, reacting the first resin with a styrene derivative represented by the formula (II) at a temperature of 0° to 50° C. in the presence of a strong acid catalyst to obtain a second resin, and reacting the second resin with a multi-valent metal salt.

* * * * *